United States Patent [19]

Beukema et al.

[11] Patent Number: 4,485,996

[45] Date of Patent: Dec. 4, 1984

[54] HEIGHT ADJUSTOR FOR FURNITURE

[75] Inventors: Duane M. Beukema, Grand Rapids; Jack R. Knoblauch, Byron Center, both of Mich.

[73] Assignee: Steelcase Inc., Grand Rapids, Mich.

[21] Appl. No.: 337,502

[22] Filed: Jan. 6, 1982

Related U.S. Application Data

[63] Continuation of Ser. No. 120,498, Feb. 11, 1980.

[51] Int. Cl.[3] ..... F16M 11/00; A47C 3/30

[52] U.S. Cl. ..... 248/407; 297/347

[58] Field of Search ..... 248/161, 404, 354 H; 108/147; 297/347, 345, 308, 349

[56] References Cited

U.S. PATENT DOCUMENTS

| | | | |
|---|---|---|---|
| 2,587,679 | 3/1952 | Atkinson | 297/349 X |
| 3,711,054 | 1/1973 | Bauer | 248/161 X |
| 3,788,587 | 1/1974 | Stemmler | 248/404 X |
| 3,790,119 | 2/1974 | Bauer | 248/161 X |
| 3,837,704 | 9/1974 | Bauer | 297/345 |
| 4,084,777 | 4/1978 | Lambert | 248/354 H |

*Primary Examiner*—Francis K. Zugel

*Attorney, Agent, or Firm*—Price, Heneveld, Huizenga & Cooper

[57] ABSTRACT

A height adjustor for funiture, such as chairs, and the like, comprises a pair of telescoping tubular members which interconnect base and seat portions of a chair and form a supportive pedestal therefor. A ram is mounted in the tubular members, such that extension and retraction of the ram respectively raises and lowers the chair seat. The ram and tubular members are sized in a manner to form an annular space therebetween which permits the ram to assume an eccentric position in the tubular members during a loaded chair condition. The ram ends are pivotally connected in the tubular members, such that lateral forces (as distinguished from vertical forces) which are applied to a chair seat are supported primarily by the tubular members, and are not transmitted to the ram.

16 Claims, 9 Drawing Figures

HEIGHT ADJUSTOR FOR FURNITURE

This is a continuation of application Ser. No. 120,498, filed Feb. 11, 1980.

BACKGROUND OF THE INVENTION

The present invention relates to furniture, and in particular to a height adjustor device therefor.

Height adjustors are typically used in conjunction with various types of furniture, such as tables, chairs, and the like, to vary the height of the supporting surface of the furniture above the ground. Dental chairs, drafting stools, operating chairs, and the like are examples of that type of furniture in which height adjustors are used.

Pneumatic and hydraulic cylinders are generally used in adjustable chairs to raise and lower the seat. Pneumatic cylinders not only provide means for adjusting the seat height, but also form a resilient column or shock absorber to improve comfort. Although this combination of features is quite desirable, the seals on such pneumatic cylinders tend to wear quickly during most types of use, thereby effectively ruining the integrity of the cylinder. A major cause of such seal damage is the application of lateral of off-centered forces to one end of the cylinder, while holding the other end of the cylinder in a static or fixed position. These lateral forces are particularly destructive when the chair is in the fully extended position, wherein the forces are effectively applied at a relatively long lever arm.

SUMMARY OF THE INVENTION

The present invention provides a ram actuated height adjustor for furniture, wherein the ram in nonfixedly mounted in a pair of telescoping tubular members for eliminating the transmittance of lateral loading to the ram, so as to improve seat adjustment reliability, as well as to extend the effective operating life of the height adjustor. The ram preferably comprises a pneumatic cylinder mounted in the telescoping tubes, with an annular space provided therebetween, and a pivot mount or articulating joint at each end of the cylinder, such that the cylinder is capable of assuming an eccentric position in the tubular members to avoid the transmittance of laterally acting forces to the cylinder.

Another aspect of the present invention is to provide a height adjustor having a base portion thereof rotatably mounted in a pair of telescoping tubes, with the upper portion of the ram telescopically received in a mating, noncircularly shaped socket, such that rotation of the chair seat is positively transmitted to the ram and rotates the same about the ram base.

These and many other important advantages of the invention will be further understood and appreciated by those skilled in the art by reference to the following written specification, claims, and appended drawings.

DETAILED DESCRIPTION OF THE PREFERRED EMBODIMENTS

Figure 1:
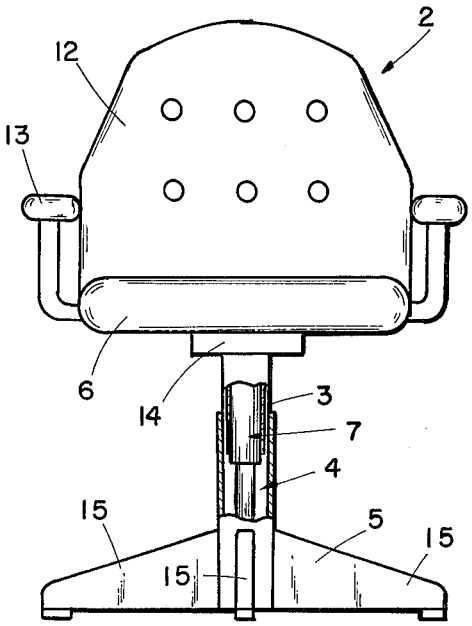
FIG. 1 is a front elevational view of the height adjustor embodying the present invention, shown mounted in a chair, with portions thereof broken away to reveal internal construction.

For purposes of description herein, the terms "upper," "lower," "right," "left," "rear," "front," "verical," "horizontal," and derivatives thereof shall relate to the invention as oriented in FIG. 1. However, it is to be understood that the invention may assume various alternative orientations, except where expressly specified to the contrary.

The reference numeral 1 (FIG. 1) generally designates a height adjustor for furniture, such as tables, stools, and the illustrated chair 2, and comprises a pair of telescoping tubular members 3 and 4 which interconnect base and seat portions 5 and 6 respectively of the chair, and form a hub tube or supportive pedestal therefor. A ram 7 is mounted in the tubular members 3 and 4, such that extension and retraction of ram 7 respectively raises and lowers chair seat 6. The ends of ram 7 are mounted in articulating joints in the associated tubular members 3 and 4, such that lateral forces which are applied to chair seat 6 are supported fully by tubular members 3 and 4, and are not transmitted to ram 7.

The illustrated chair 2 includes a back 12, a pair of arms 13, and a mounting bracket 14 connected with the bottom of chair seat 6 and adapted for attaching height adjustor 1 thereto. Bracket 14 may be a portion of a tilt assembly. Lateral forces are applied to chair base 5 by the user as a result of any force which is not directly in-line with the supportive pedestal. Hence, when the user's weight is applied to the chair seat in a slightly off-center manner, in either a side-to-side or forward and back relationship, lateral forces are applied to the chair base. In a similar manner, the uneven application of force to the chair arms 13 results in lateral forces, as does force applied to the back 12 of the chair to position the same in a reclined orientation. The chair base 5 includes a plurality of outwardly extending legs 15 which are of sufficient length to counteract the torque applied thereto by the lateral forces and thereby support the chair without tipping.

Figure 2:
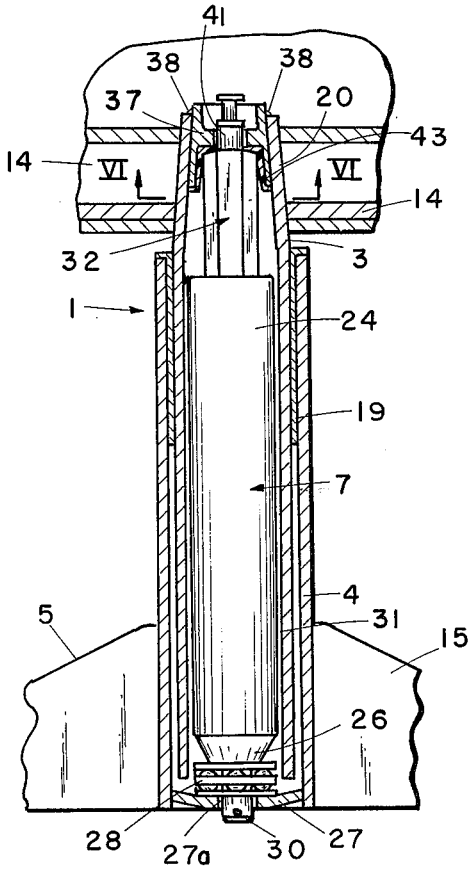
FIG. 2 is a vertical cross-sectional view of the chair and height adjustor in a retracted position.
Figure 3:
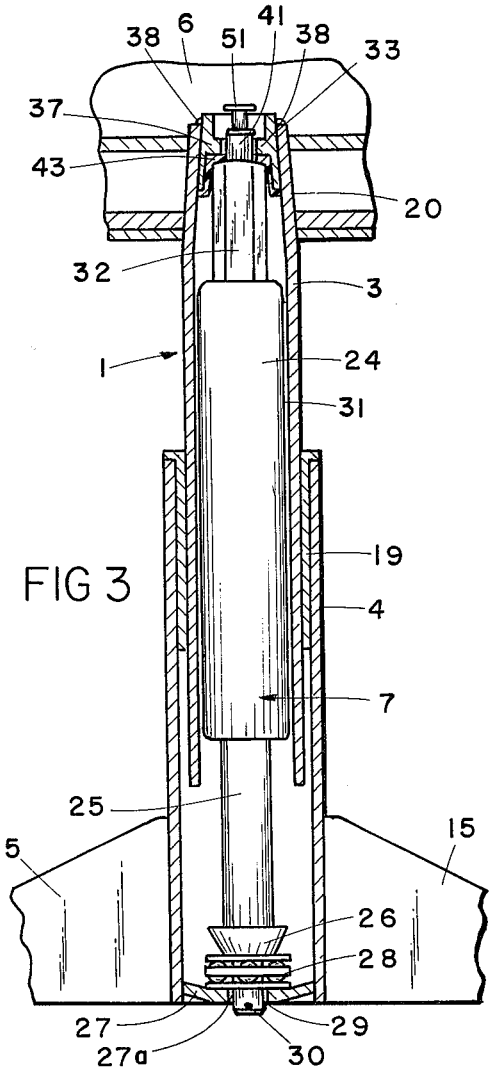
FIG. 3 is a vertical cross-sectional view of the chair and height adjustor, shown in a fully extended position.
Figure 5:
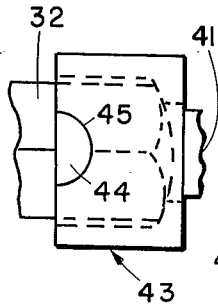
FIG. 5 is an enlarged, fragmentary side elevational view of the articulating joint assembly.
Figure 6:
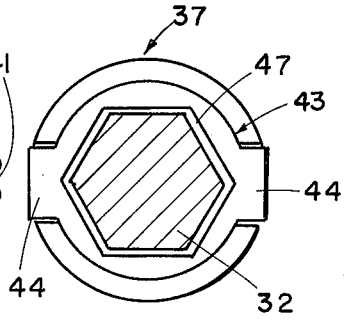
FIG. 6 is an enlarged, horizontal cross-sectional view of the articulating joint assembly, taken along the line VI—VI, FIG. 2.

As best illustrated in FIGS. 2 and 3, the lower tubular member 4 is fixedly attached to chair legs 15 and extends upwardly thereof. The upper tubular member 3 is received telescopically within the lower tubular member 4, and a bearing sleeve 19 is disposed therebetween to facilitate smooth extension and retraction of tubular members 3 and 4, as well as to provide a close tolerance and telescoping fit. Preferably, tubular members 3 and 4, as well as sleeve 19, have a cylindrical shape. The upper end 20 of tubular member 3 is frustroconically shaped, and fixedly connected in the controller bracket 14 of the chair, such that forces on chair seat 6 are transmitted to upper tubular member 3.

The ram 7 may be hydraulic, electrical, or the like, but is preferably pneumatic and self-contained, and includes a housing 24 (FIGS. 2 and 3) from which an extending and retracting rod 25 is disposed in a downwardly direction. A rubber bumper 26 is positioned on the lower end of rod 25 to absorb impact with housing 24 upon full retraction of the cylinder. The rod 25 is rotatably mounted on the base 27 of lower tubular member 4 by a ball thrust bearing 28. The lower extreme end 29 of rod 25 extends through a mating aperture 27*a* in base 27, and includes a lateral aperture 30 therethrough in which a retaining clip or pin (not shown) is positioned to hold cylinder rod 25 in place. The gap formed between rod end 29 and mating base aperture 27*a* is sufficient to permit ram 7 to pivot within tubular members 3 and 4. The cylinder housing 24 is sized slightly smaller than the interior surface of upper tubular member 3, such that an annularly shaped gap 31 is formed therebetween. The ram 7 is typically disposed in a coaxial relationship with tubular members 3 and 4 during a nonloaded chair condition (FIGS. 2 and 3). The upper end of ram housing 24 includes a stud 32 having a noncircular lateral cross-sectional shape which is received in a mating socket 33, so as to positively transmit rotation of chair seat 6 to ram 7. In the illustrated example, the stud 32 is in the shape of a hexagon.

Figure 4:
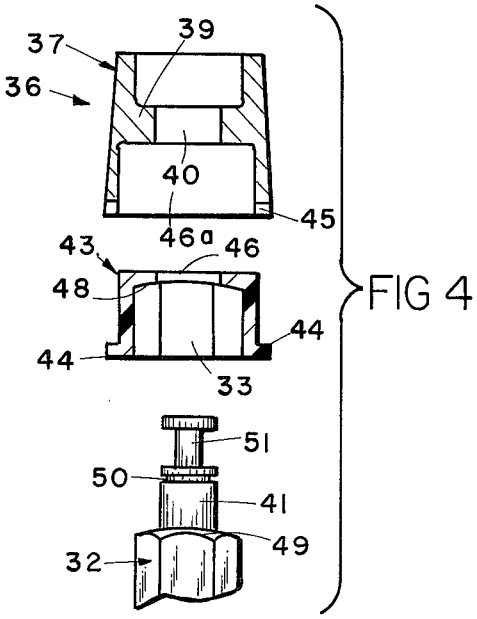
FIG. 4 is an exploded elevational view of an articulating joint assembly which effectively eliminates transmittance of lateral forces to the cylinder portion of the height adjustor.

An articulating joint assembly 36 (FIG. 4) permits chair seat 6 to pivot slightly with respect to ram 7, such that ram 7 is nonfixedly mounted in tubular members 3 and 4. The articulating joint assembly 36, and the pivot mounting of rod end 29 in base 27 effectively eliminate the transmittal of lateral forces to ram 7. The articulating joint assembly 36 includes an adapter housing 37 fixedly mounted in the upper end of tubular member 3 by suitable means, such as welds 38 (FIG. 3), and an insert or adapter 43. It is to be understood, however, that the present invention also contemplates constructing housing 37 and adapter 43 with a one-piece design. The illustrated adapter housing 37 (FIG. 4) has a frustroconical shape which mates with the interior surface of the upper end of tubular member 3, and includes a central web 39 with a concentrically positioned aperture 40 therein adapted to loosely receive a corresponding end portion or pin 41 extending from stud 32. The housing aperture 40 is sufficiently large in relation to the outside diameter of pin 41, that adapter housing 27 may assume a cocked or eccentric relationship with pin 41 when severe lateral forces are applied to the chair. The insert 43 is substantially cylindrical in shape, with a pair of ears 44 projecting from the bottom surface thereof to mate with corresponding notches 45 in the adapter housing 37, and includes an axial aperture 46 which mates with aperture housing 40, and is coextensive in size. The insert 43 fits snugly into the lower cylindrical cavity 46*a* in the adapter housing 37, and rotation is transmitted therebetween as a result of the engagement of ears 44 in notches 45. The insert 37 is preferably constructed of a self-lubricating material, such as nylon or the like. The socket 33 is formed in insert 43, and includes a hexagon lateral cross-sectional shape which mates with the shape of stud 32, and loosely receives the same therein. As best illustrated in FIGS. 5–8, socket 33 is larger than stud 32 so as to form a gap 47 between the side walls thereof having sufficient width to permit insert 43 to pivot or articulate slightly on top of stud 32, yet transmit rotation therebetween. The upper interior surface 48 of insert 43, and the upper surface 49 of stud 32 are matingly and arcuately shaped, and cooperate in the manner illustrated in FIGS. 7 and 8 to permit pivoting or articulation therebetween as described in greater detail hereinbelow. A groove 50 is provided at the free end of pin 41, and is shaped to receive a snap ring (not shown) therein to retain the articulating joint assembly in a loose or nonrigid assembled condition. A conventional controller 51 for ram 7 extends through apertures 46 and 40, and is connected with means such as an arm (not shown) to reciprocate the controller 51 for adjusting the height of the chair seat 6.

Figure 7:
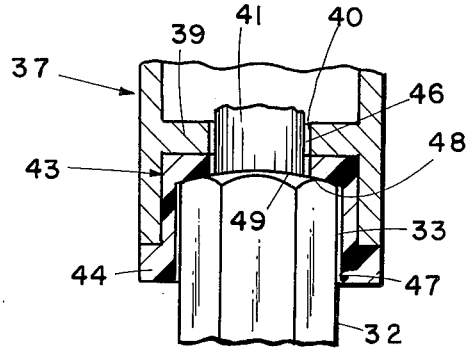
FIG. 7 is an enlarged, vertical cross-sectional view of the articulating joint assembly, shown in an axially loaded condition.

In use, when only axial forces are applied to the chair seat 6, the housing 37 and insert 43 sit squarely on stud 32, as illustrated in FIG. 7, and ram 7 supports these forces. If chair seat 6 is rotated, upper tubular member 3 rotates in sleeve 19, and the stud 32 and socket 33 positively transmit this rotation to the ram 7 which bodily rotates about bearing 28. The seat height may be easily adjusted by extending or retracting ram 7 in a conventional fashion through manipulation of controller 51.

Figure 8:
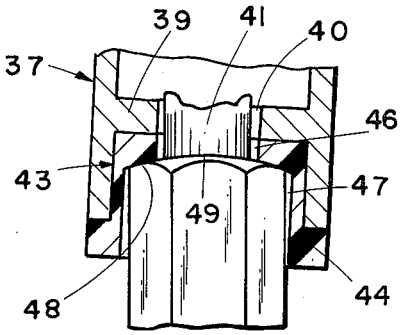
FIG. 8 is an enlarged, vertical cross-sectional view of the articulating joint assembly, shown in a non-axially loaded condition.
Figure 9:
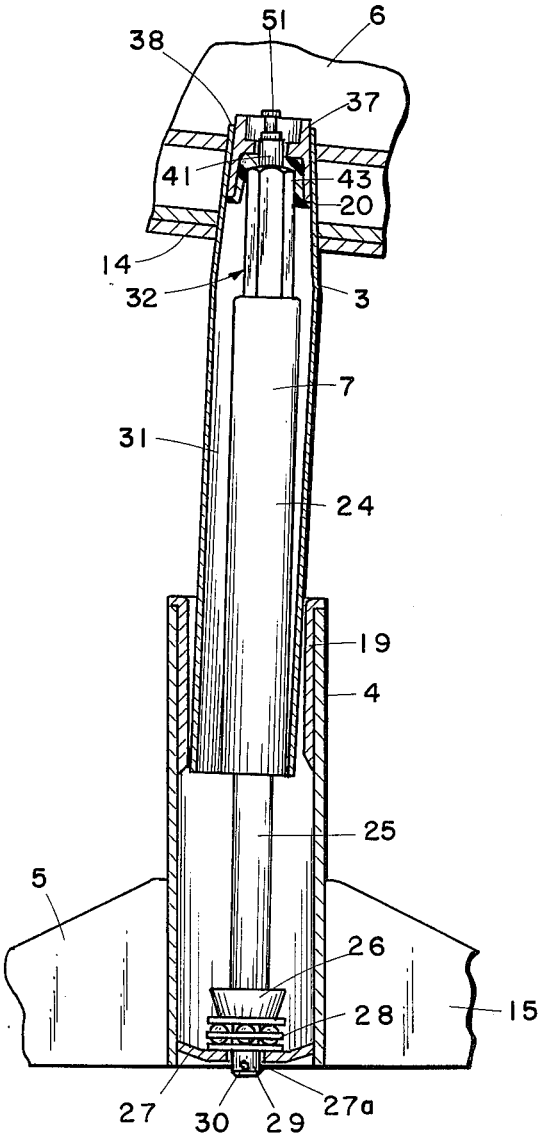
FIG. 9 is an exaggerated vertical cross-sectional view of the chair and height adjustor, shown in a fully extended, nonaxially loaded condition.

When lateral forces are applied to the seat, such as shown in FIG. 9 (wherein chair 2 and the space 31 between ram 7 and tubes 3 and 4 are shown in an exaggerated condition for illustrative purposes only) seat 6 will tend to assume a nonhorizontal position, and upper tubular member 3 will tend to cock with respect to the lower tubular member 4 as a result of the slight gap disposed about sleeve 19 as a result of manufacturing tolerances, and sliding wear. Heretofore, these lateral forces would have been transmitted directly to ram 7, because the ram would tend to maintain a vertical orientation and resist the cocking motion. It is this type of force which ruins the seals in the pneumatic ram, particularly when the seat is raised and lowered under such conditions. In the present height adjustor 1, because ram 7 is nonfixedly mounted in the tubular member 3 and 4, ram 7 does not resist this cocking motion, and therefore the lateral forces are not transmitted thereto. As best shown in FIG. 8, when high lateral loads are applied to the chair 2, insert 43 tends to assume a slightly nonhorizontal orientation. However, as a result of the arcuate shape of the interconnecting surfaces 48 and 49, as well as gap 47 and the aperture formed between pin 41 and openings 46 and 40, seat 6 is allowed to pivot slightly or articulate with respect to stud 32. In a similar manner, the lower terminal end 29 of the ram rod 25 is allowed to pivot slightly or articulate in the base aperture 27*a*, whereby the ram 7 can assume an inclined orientation within tubular members 3 and 4 to effectively prevent the application of lateral forces thereto. The gap 31 (shown exaggerated in FIG. 9) between ram 7 and tubular members 3 and 4 permits the ram to assume an inclined orientation when chair seat 6 is subjected to high nonaxial loading. Because gap 31 is annular in shape and ram 7 normally assumes a substantially coaxial relationship therein, the ram inclination to avoid lateral loading can take place no matter what direction the off-centered force is applied from, including side-to-side, back-to-front, and variations thereof.

In the foregoing description, it will be readily appreciated by those skilled in the art that many modifications may be made to the invention without departing from the concepts disclosed herein. Such modifications are to be considered as included in the following claims unless these claims by their language expressly state otherwise.

The embodiments of the invention in which an exclusive property or privilege is claimed are defined as follows:

1. In a chair, an improved height adjustment device therefor, comprising:

a pair of telescoping tubular members interconnecting a base portion and a seat portion of said chair;

a ram mounted within said tubular members and having a lowered end thereof connected with one of said tubular members, and an upper end thereof connected with the other of said tubular members, whereby extension and retraction of said ram respectively raises and lowers said chair seat portion; said ram normally assuming a substantially concentric relationship with said tubular members during a nonloaded chair condition; and said ram and tubular members being mutually sized in a radial direction to form a space therebetween for permitting said ram to assume an eccentric relationship with said tubular members during a loaded chair condition;

means for permitting said upper and lower ram ends to pivot with respect to the associated tubular member in which they are connected, whereby lateral forces which are applied to the chair seat during use are supported wholly by said tubular members, and are not transmitted to said ram;

means for rotatably mounting the lower end of said ram in said device; and connector means for interconnecting the upper end of said ram and the other of said tubular members to prevent rotation therebetween, whereby rotation of said chair seat portion is positively transmitted to said ram and rotates the same about said mounting means, said connector means including an upper surface which abuttingly mates with a terminal surface on the upper end of said ram to form an articulating joint portion of said pivot means for eliminating the transmission of lateral forces to said ram.

2. A height adjustment device as set forth in claim 1, wherein:

said ram comprises a pneumatic cylinder.

3. A height adjustment device as set forth in claim 2 wherein said connector means further comprises:

a seat mounting bracket shaped for fixed connection with a lower surface of said chair seat portion, and including a noncircularly shaped socket therein; and a stud extending upwardly and axially from said ram upper end, and including a noncircularly shaped portion mating with and telescopingly received in said seat mounting member socket.

4. A height adjustment device as set forth in claim 3, wherein:

said socket includes said upper surface which is arcuately shaped and abuttingly mates with an arcuately shaped free end of said stud comprising said terminal surface to form said articulating joint portion.

5. A height adjustment device as set forth in claim 2, wherein said connector means further comprises:

a seat mounting member for connection with a lower surface of said chair seat portion;

a stud extending upwardly and axially from said ram upper end and including a pin received in a mating aperture in said seat mounting bracket; and wherein;

said pivot means includes:

an annularly shaped space disposed between said ram pin and said mounting member aperture for permitting said mounting member to assume an eccentric relationship with said ram pin;

said terminal surface on the upper end of said ram stud being arcuately shaped and supporting said seat mounting member thereon; and said seat mounting member including said upper surface being arcuately shaped and mating with and abutting said ram terminal surface, thereby permitting slight pivoting between said chair seat portion and said ram.

6. A height adjustment device as set forth in claim 5, wherein:

said seat mounting member has a separate insert portion disposed adjacent said stud, and includes said arcuate surface thereon.

7. A height adjustment device as set forth in claim 6, wherein:

said insert is constructed of a synthetic resin material for antifriction abutment with said stud surface.

8. A height adjustment device as set forth in claim 7, wherein:

said insert has a socket shaped body into which said stud is received;

said stud and insert are sized to form a space therebetween for permitting pivoting between said abutting arcuate surfaces.

9. A height adjustment device as set forth in claim 8, wherein:

said insert socket and said stud have a hexagonal lateral cross-sectional shape, and are sized to form a space therebetween sufficient to permit pivoting between said abutting arcuate surfaces, yet positively transmit rotation of said chair seat portion to said ram.

10. In a chair having a pneumatic height adjustment device comprising a pair of telescoping tubular members interconnecting a base portion and a seat portion of the chair, and a ram mounted within said tubular members and having a lower end thereof connected with one of said tubular members, and an upper end thereof connected with the other of said tubular members, whereby extension and retraction of said ram respectively raises and lowers said chair seat portion, the improvement comprising:

means defining an annularly shaped space between said ram and said tubular members; said ram normally assuming a substantially concentric relationship with said tubular members during a nonloaded chair condition, and said space permitting said ram to assume an eccentric relationship with said tubular members during a selected loaded chair condition;

means for permitting said upper and lower ram ends to pivot with respect to the associated tubular member in which they are connected, whereby lateral forces which are applied to the chair seat during use are supported wholly by said tubular members, and are not transmitted to said ram;

means for rotatably mounting the lower end of said ram in said device;

connector means for interconnecting the upper end of said ram and the other of said tubular members to prevent rotation therebetween, whereby rotation of said chair seat portion is positively transmitted to said ram and rotates the same about said mounting means, said connector means including an upper surface which abuttingly mates with a terminal surface on the upper end of said ram to form an articulating joint portion of said pivot means for eliminating the transmission of lateral forces to said ram.

11. A chair as set forth in claim 10, wherein said connector means further comprises:

a seat mounting member connected with a lower surface of said chair seat portion;

a stud extending upwardly and axially from said ram upper end and including a pin received in a mating aperture in said seat mounting member; and wherein;

said pivot means includes:

an annularly shaped space disposed between said ram pin and said mounting bracket apertures for permitting said mounting member to assume an eccentric relationship with said ram pin;

said terminal surface on the upper end of said ram stud being arcuately shaped and supporting said seat mounting bracket thereon;

said seat mounting bracket including said upper surface being arcuately shaped and mating with and abutting said ram terminal surface, thereby permitting slight pivoting between said chair seat portion and said ram for avoiding the application of nonlongitudinally oriented forces to said ram.

12. A chair as set forth in claim 10, wherein said connector means further comprises:

a seat mounting bracket fixedly connected with a lower surface of said chair seat portion, and including a noncircularly shaped socket thereon; and a stud extending upwardly and axially from said ram upper end and including a noncircularly shaped portion mating with and telescopingly received in said seat mounting bracket socket.

13. A height adjustment device for chairs, comprising:

a pair of telescoping tubular members for interconnecting a base portion and a seat portion of a chair;

a ram comprising a pneumatic cylinder mounted within said tubular members and having a lower end thereof connected with one of said tubular members, and an upper end thereof connected with the other of said tubular members, whereby extension and retraction of said ram respectively raises and lowers said chair seat portion; said ram normally assuming a substantially concentric relationship with said tubular members during a nonloaded chair condition; and said ram and tubular members being mutually sized in a radial direction to form a space therebetween for permitting said ram to assume an eccentric relationship with said tubular members during a loaded chair condition;

means for permitting said upper and lower ram ends to pivot with respect to the associated tubular member in which they are connected, whereby lateral forces which are applied to the chair seat during use are supported wholly by said tubular members, and are not transmitted to said ram;

means for rotatably mounting the lower end of said ram in said device; and connector means for interconnecting the upper end of said ram and the other of said tubular members to prevent rotation therebetween, whereby rotation of said chair seat portion is positively transmitted to said ram and rotates the same about said mounting means, said connector means including an upper surface which abuttingly mates with a terminal surface on the upper end of said ram to form an articulating joint portion of said pivot means for eliminating the transmission of lateral forces to said ram; said connector means further including a seat mounting bracket shaped for fixed connection with a lower surface of said chair seat portion, and including a noncircularly shaped socket therein; said connector means additionally including a stud extending upwardly and axially from said ram upper end, and including a noncircularly shaped portion mating with and telescopingly received in said seat mounting member socket.

14. A height adjustment device as set forth in claim 13, wherein:

said socket includes said upper surface being arcuately shaped and which abuttingly mates with said terminal surface being arcuately shaped of said free end of said stud to form said articulating joint portion.

15. In a chair, an improved height adjustment device therefor, comprising:

a pair of telescoping tubular members interconnecting a base portion and a seat portion of said chair;

a ram mounted within said tubular members and having a lower end thereof connected with one of said tubular members, and an upper end thereof connected with the other of said tubular members, whereby extension and retraction of said ram respectively raises and lowers said chair seat portion; said ram normally assuming a substantially concentric relationship with said tubular members during a nonloaded chair condition; and said ram and tubular members being mutually sized in a radial direction to form a space therebetween for permitting said ram to assume an eccentric relationship with said tubular members during a loaded chair condition;

means for permitting said upper and lower ram ends to pivot with respect to the associated tubular member in which they are connected, whereby lateral forces which are applied to the chair seat during use are supported wholly by said tubular members, and are not transmitted to said ram;

means for rotatably mounting the lower end of said ram in said device; and a connector having means for interconnecting the upper end of said ram and the other of said tubular members to prevent rotation therebetween, whereby rotation of said chair seat portion is positively transmitted to said ram and rotates the same about said mounting means;

said connector including an arcuately shaped upper surface which abuttingly mates with an arcuately shaped surface on the upper end of said ram to form an articulating joint portion of said pivot means for eliminating the transmission of lateral forces to said ram.

16. A height adjustment device as set forth in claim 15, wherein said connector comprises:

a seat mounting bracket shaped for fixed connection with a lower surface of said chair seat portion, and including a noncircularly shaped socket therein with said arcuately shaped upper surface; and a stud extending upwardly and axially from said ram upper end, and including a noncircularly shaped portion mating with and telescopingly received in said seat mounting member socket; said stud having said arcuately shaped upper surface thereon to form said articulated joint portion of said pivot means.

* * * * *